US008336797B2

(12) United States Patent
Wakamatsu et al.

(10) Patent No.: US 8,336,797 B2
(45) Date of Patent: Dec. 25, 2012

(54) POWDER AND GRANULAR MATERIAL CRUSHING AND SIZING APPARATUS

(75) Inventors: Yoshihiro Wakamatsu, Hokkaido (JP); Yoshinori Hanada, Tokyo (JP)

(73) Assignee: Nara Machinery Co., Ltd., Tokyo (JP)

( * ) Notice: Subject to any disclaimer, the term of this patent is extended or adjusted under 35 U.S.C. 154(b) by 301 days.

(21) Appl. No.: 12/923,203

(22) Filed: Sep. 9, 2010

(65) Prior Publication Data

US 2011/0062264 A1 Mar. 17, 2011

(30) Foreign Application Priority Data

Sep. 11, 2009 (JP) ..... 2009-210094

(51) Int. Cl.
*B02C 13/282* (2006.01)

(52) U.S. Cl. ..... 241/189.1; 241/191; 241/195; 241/285.2

(58) Field of Classification Search ..... 241/189.1, 241/191, 195, 285.2
See application file for complete search history.

(56) References Cited

U.S. PATENT DOCUMENTS 4,907,750 A * 3/1990 Seifert ..... 241/73

FOREIGN PATENT DOCUMENTS

JP B2-4113222 4/2008

* cited by examiner

*Primary Examiner* — Mark Rosenbaum
(74) *Attorney, Agent, or Firm* — Posz Law Group, PLC

(57) ABSTRACT

Provided is a powder and granular material crushing and sizing apparatus in which stators are easy to disassemble and assemble, i.e. in which disc-like rotors and stators can be cleaned and replaced easily. A drive shaft, on which a plurality of disc-like rotors are disposed, is supported in a cantilever manner on a bearing housing. A plurality of stators are disposed on a holder to make up a stator assembly. The stator assembly is detachably disposed in the bearing housing. An opening is formed in a side wall of the casing. The disc-like rotors and the stator assembly are housed via the opening, and the casing is detachably disposed on the bearing housing. ion.

5 Claims, 8 Drawing Sheets

(A)

(B)

POWDER AND GRANULAR MATERIAL CRUSHING AND SIZING APPARATUS

BACKGROUND OF THE INVENTION

1. Field of the Invention

The present invention relates to a powder and granular material crushing and sizing apparatus for sizing, to a predetermined particle size, various wet or dry materials such as pharmaceuticals, foodstuffs, fodder, chemicals, fertilizers, powdered coal, limestone or ceramics materials that are granulated or formed by various apparatuses. More particularly, the present invention relates to a powder and granular material crushing and sizing apparatus that crushes granules (lumps) of a target particle size or greater, such as wet aggregates or dry blocks granulated or formed by various apparatuses, and that sizes the granules within a given particle size range.

2. Description of the Related Art

Mixing, granulating and sizing operations of powder and granular materials are widely carried out in numerous industrial fields, such as in the pharmaceutical and food industries. Particle size adjustment is an important unit operation in production processes, with a view to, for instance, improving the quality of the powder and granular material, increasing fluidity during fluidized drying, and improving handling. A crushing and sizing apparatus is used for the above particle size adjustment operation.

The applicant has disclosed such a powder and granular material crushing and sizing apparatus in Japanese Patent No. 4113222.

The powder and granular material crushing and sizing apparatus comprises a plurality of disc-like rotors fixedly supported, at intervals, by a drive shaft provided in a horizontal direction; and a plurality of semi-circular arc stators provided below the disc-like rotors and that oppose disc faces of the peripheral edge thereof, the stators having inclined faces such that the gap between the stators and the disc faces of the disc-like rotors becomes narrower towards the peripheral edges of the disc-like rotors; wherein the disc faces of the disc-like rotors and the inclined faces of the stators form hopper-like gap portions where a powder and granular material is held, and wherein the narrowest gap portions between the peripheral edges of the disc-like rotors and the stators form crushing and sizing sections.

In the above powder and granular material crushing and sizing apparatus, the powder and granular material to be processed is fed, from above the disc-like rotors, to the gap portions that are delimited by the peripheral-edge disc faces of the disc-like rotors and the inclined faces of the stators. The powder and granular material is crushed and sized at the narrowest gap portions and is discharged downwards.

In the above powder and granular material crushing and sizing apparatus, the disc-like rotors and the stators had to be disassembled to be cleaned. However, the structure of the apparatus is such that the plurality of stators is assembled, interposing spacers between the disc-like rotors, to a plurality of fixed shafts disposed across the interior of a casing. Therefore, removal and mounting of the stators was cumbersome. To replace the disc-like rotors, moreover, it was necessary to remove first a powder and granular material charging casing and a casing main body, remove next a belt from a pulley, remove a drive shaft, with the disc-like rotors fixed thereto, from the bearing that holds the drive shaft, and remove thereafter the disc-like rotors from the drive shaft. To mount the disc-like rotors, the above procedure had to be carried out in reverse order, which made for a cumbersome removal and mounting of the disc-like rotors.

SUMMARY OF THE INVENTION

In the light of the above, it is an object of the present invention to provide a powder and granular material crushing and sizing apparatus in which stators are easy to disassemble and assemble, i.e. in which disc-like rotors and stators can be cleaned and replaced easily.

With a view to attaining the above goal, the powder and granular material crushing and sizing apparatus of the present invention is a powder and granular material crushing and sizing apparatus in which a powder and granular material fed through an upper feeding opening of a casing is crushed and sized at gaps that are formed by peripheral-edge disc faces of a plurality of disc-like rotors disposed, at a predetermined spacing, on a horizontal drive shaft, and a plurality of stators disposed between lower peripheral edges of the plurality of disc-like rotors, and in which the crushed and sized powder and granular material is discharged towards a bottom discharge opening of the casing; wherein the drive shaft is supported in a cantilever manner on a bearing housing, the plurality of stators are disposed on a holder to make up a stator assembly, the stator assembly is detachably disposed in the bearing housing, an opening is formed on a side wall of the casing, the disc-like rotors and the stator assembly are housed via the opening, and the casing is detachably disposed on the bearing housing.

In the invention, the casing is detachably disposed on the bearing housing in such a manner that the casing covers the drive shaft. The casing can thus be removed easily. The stator assembly provided with the plurality of stators is detachably disposed on the bearing housing. The plurality of stators can be removed thus simultaneously from the disc-like rotors by removing the stator assembly from the bearing housing. As a result, the disc-like rotors and the stators can be cleaned easily and quickly.

According to the present invention, the free end of the drive shaft will be exposed, simply by removing the casing. Thus the exchange of the disc-like rotors is easy. A plurality of stators can be exchanged at a time, by removing the stator assembly, and by mounting another stator assembly that is prepared for exchange. In this way, the exchange of the rotors and the stators can be completed easily and quickly. Consequently a quick adjustment of the spacing at the crushing and sizing section (at the narrowest gap portion), i.e. the adjustment of the particle size, is possible.

In the above invention, the stator assembly may be formed by arranging the stators, shaped as a semicircular arc and having a substantially triangular cross-sectional shape, at band-like portions formed on a holder having a semi-tubular shape concentric with the disc-like rotors and in which a plurality of long holes are formed, along a circular arc, at positions corresponding to the lower peripheral edges of the disc-like rotors, the band-like portions being formed between the long holes.

In the invention, there is prepared a plurality of stator assemblies with modified long hole width, such that the spacing between the crushing and sizing sections (narrowest gap portions), i.e. the sizing particle size, can be adjusted very quickly by exchanging the stators assemblies.

In the above invention, cylindrical pins having a flat portion in a part thereof may be standingly provided on the peripheral-edge disc faces of the disc-like rotors, in such a manner that the flat portion tilts rearwards in an advance direction of the disc-like rotors as the flat portion extends towards the peripheral edge of the disc-like rotor.

In the invention, the material to be processed is pushed out by the flat portions of the pins, accompanying the rotation of the disc-like rotors, towards the gaps between the peripheral edges of the disc-like rotors and the stators. This allows increasing the crushing and sizing efficiency of the material to be processed.

In the above invention, an intermediate portion of the pins, in the longitudinal direction, may be shaped as a non-cylinder, holes having a shape corresponding to a cross sectional shape of the intermediate portion of the pins may be formed in the disc-like rotors, and the flat portions of the pins may be positioned so as to face towards a predetermined direction by inserting the intermediate portion of the pins into the holes.

In the invention, the flat portions are positioned by simply fitting, through insertion, the intermediate portion of the pins, in the longitudinal direction, into holes in the disc-like rotors. This makes the pin mounting operation easier.

In the above invention, the stators may be formed of polytetrafluoroethylene.

The invention allows preventing adhesion (deposition) of the material to be processed thanks to the smoothness of the polytetrafluoroethylene surface.

BRIEF DESCRIPTION OF THE DRAWINGS

FIG. 7 is a diagram illustrating the way in which pins are embedded in the disc-like rotor illustrated in FIG. 3, wherein FIG. 7A is a front-view diagram and FIG. 7B a cross-sectional diagram;

FIG. 8 is a diagram illustrating the way in which pins are embedded in the disc-like rotor illustrated in FIG. 3, wherein FIG. 8A is a front-view diagram and FIG. 8B a cross-sectional diagram;

FIG. 9 is a diagram illustrating a stator assembly in the powder and granular material crushing and sizing apparatus according to the present invention, with stators and a holder disassembled, wherein FIG. 9A is a perspective-view diagram of the stators, FIG. 9B is a perspective-view diagram of the holder, and FIG. 9C is an enlarged cross-sectional diagram of a portion along line I-I in diagram of FIG. 9A, illustrating a cross section structure of the stators;

FIG. 10 is a diagram illustrating a stator assembly in the powder and granular material crushing and sizing apparatus according to the present invention, wherein FIG. 10A is a perspective-view diagram illustrating the whole, and FIG. 10B is an enlarged cross-sectional diagram of a portion, along line II-II in diagram of FIG. 10A, illustrating a fixed structure of the stators and the holder.

DESCRIPTION OF THE PREFERRED EMBODIMENTS

Figure 1:
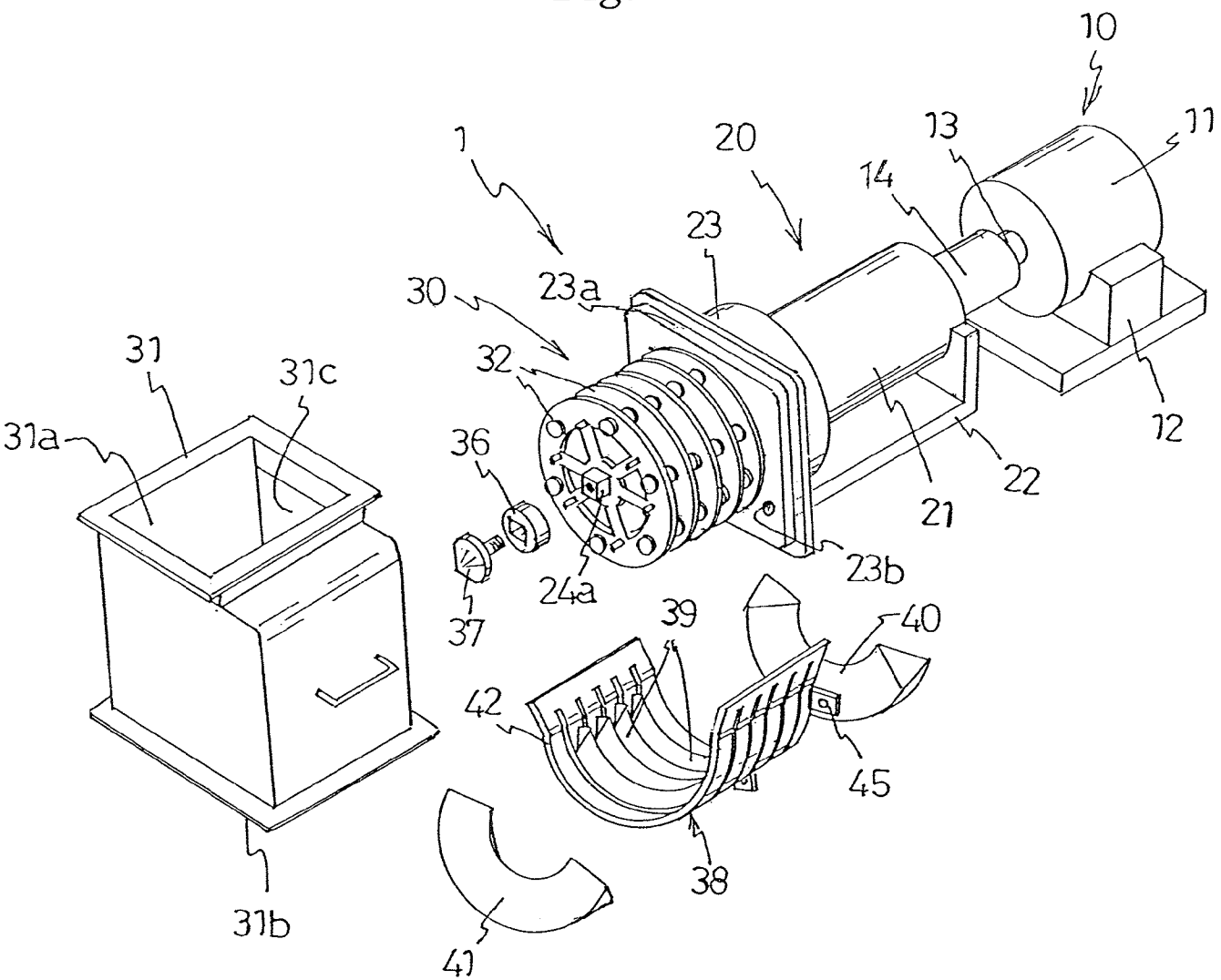
FIG. 1 is an exploded perspective-view diagram illustrating conceptually a powder and granular material crushing and sizing apparatus according to the present invention.

The powder and granular material crushing and sizing apparatus according to the present invention will be explained in detail below on the basis of embodiments illustrated in the drawings.

The powder and granular material crushing and sizing apparatus 1 according to the present invention illustrated in the drawings comprises a power section 10, a bearing section 20, and a powder and granular material crushing and sizing section 30.

In the power section 10, a motor 11 is supported on a motor base 12, and an output shaft 13 protrudes in the horizontal direction.

Figure 2:
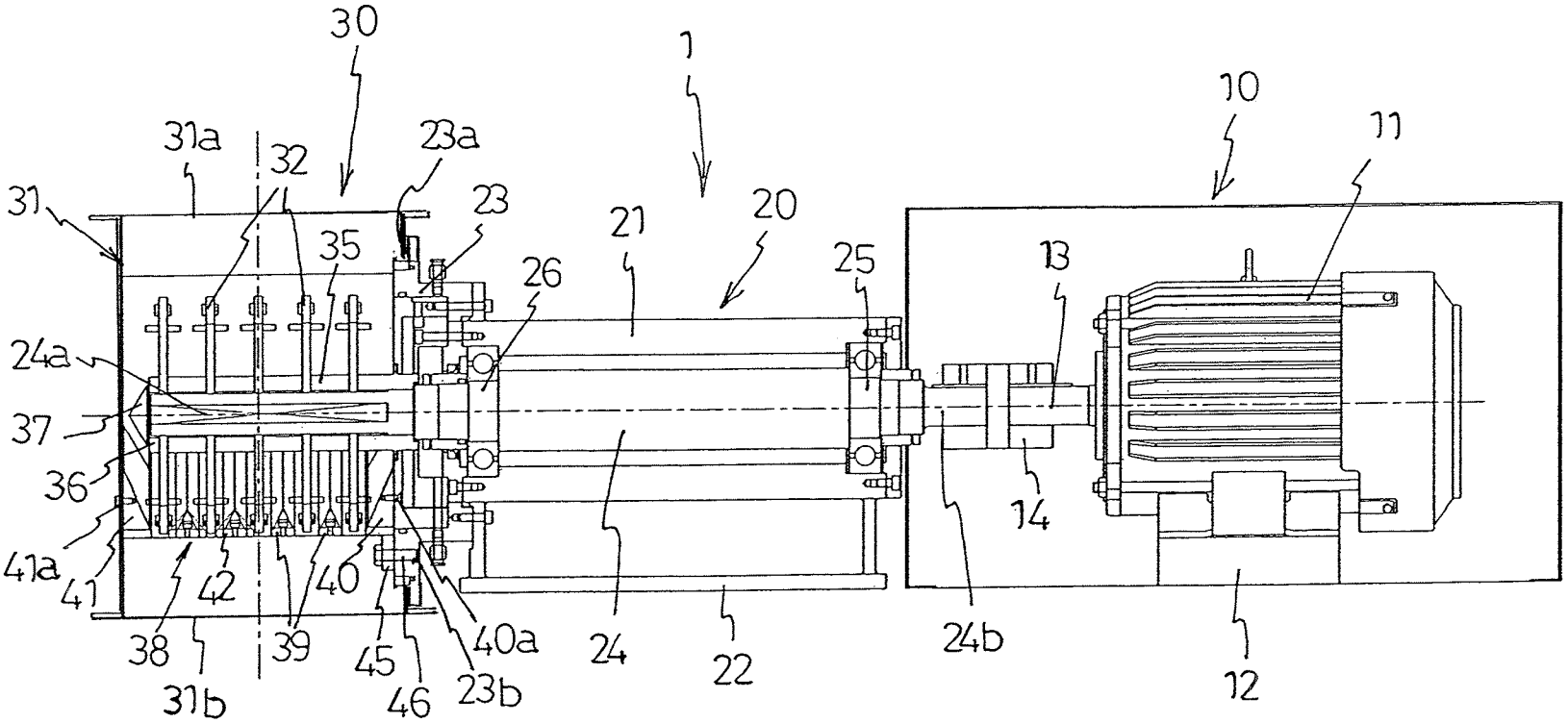
FIG. 2 is a vertical cross-sectional diagram of the powder and granular material crushing and sizing apparatus according to the present invention.
Figure 3:
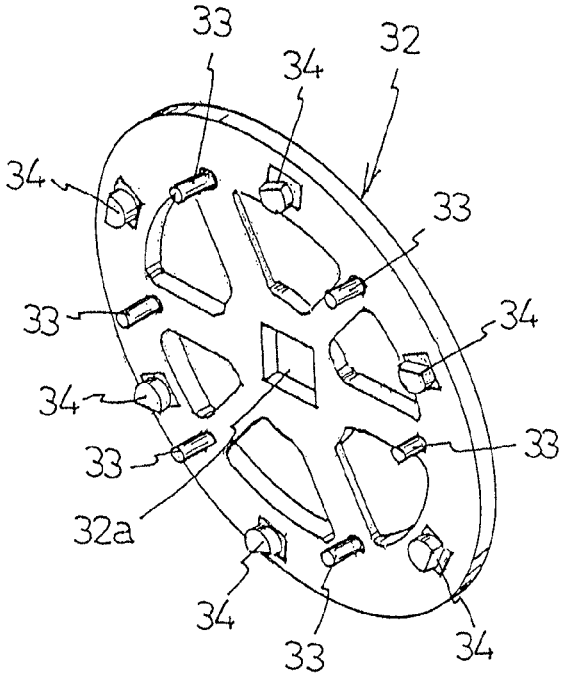
FIG. 3 is a perspective-view diagram illustrating a disc-like rotor of the powder and granular material crushing and sizing apparatus according to the present invention.

In the bearing section 20, a tubular bearing housing 21 is supported on a base 22, and a rectangular bracket 23 is disposed at one end of the bearing housing 21. Inside the bearing housing 21, both ends of a drive shaft 24 are supported by ball bearings 25, 26, as illustrated in FIG. 2. One end of the drive shaft 24 extends into the crushing and sizing section 30 via the bracket 23. The cross section, perpendicular to the shaft center, of an extension 24*a* of the drive shaft 24 is rectangular in shape. The other end 24*b* of the drive shaft 24 is coupled to an output shaft 13 of the motor 11 via a coupling 14.

The crushing and sizing section 30 comprises a casing 31 shaped as a square tube that has a powder and granular material feeding opening 31*a* at the upper portion, and a discharge opening 31*b* of crushed and sized powder, at the lower portion. An opening 31*c* is formed at one side face of the casing 31. One side face of the bracket 23, on the side of the crushing and sizing section 30, is cut out, to a constant depth, over the entire periphery of the side face. The opening 31*c* of the casing 31 is fitted to the cutout portion 23*a* of the bracket 23 in a manner so as to form a spigot ferrule joint, and is fixed to the bracket 23 by some appropriate means (not shown), such as a snap fastener (gate fastener), or by way of bolts and nuts. In that state, the extension 24*a* of the drive shaft 24 is housed inside the casing 31.

A plurality of (in the present embodiment, five) disc-like rotors 32, which are one of the main elements of the crushing and sizing section 30, are fitted to the extension 24*a* of the drive shaft 24.

As illustrated in FIG. 3 to FIG. 6, the disc-like rotors 32 comprise each a rectangular hole 32*a*, corresponding to the extension 24*a* of the drive shaft 24, formed in the central portion of the disc-like rotor; a plurality of (in the present embodiment, six) cylindrical pins 33 equidistantly disposed at the peripheral edge of both disc faces, and a plurality of (in the present embodiment, six) cylindrical pins 34 equidistantly arrayed, between respective pins 33, further out towards the peripheral edge than the pins 33.

Figure 4:
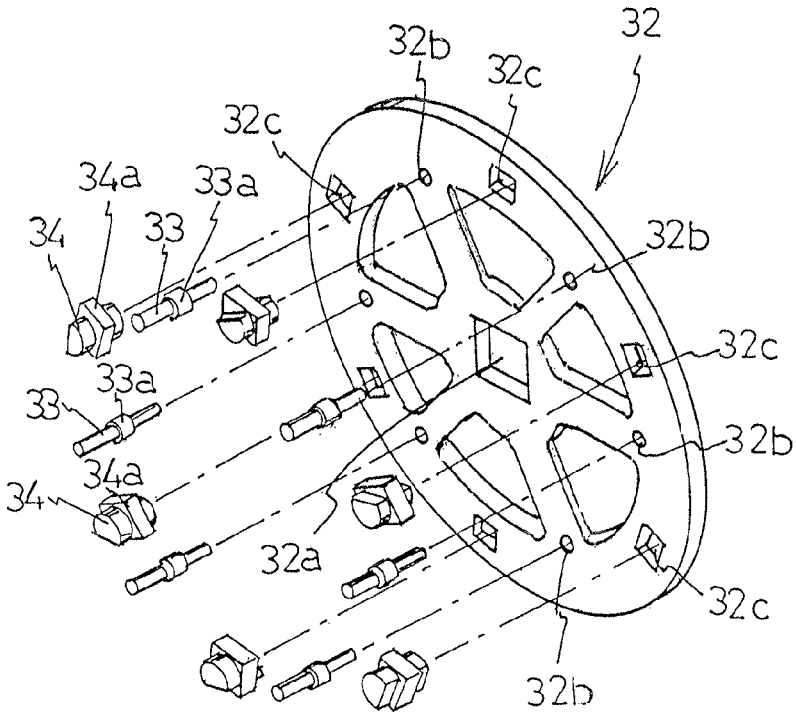
FIG. 4 is an exploded perspective-view diagram of the disc-like rotor illustrated in FIG. 3.
Figure 5:
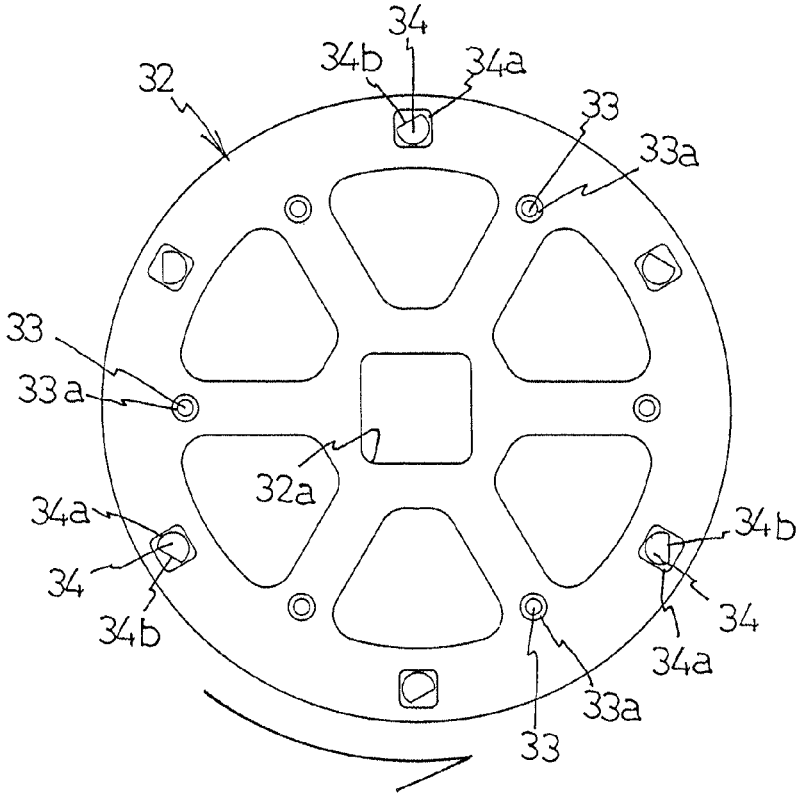
FIG. 5 is a front-view diagram of the disc-like rotor illustrated in FIG. 3.
Figure 6:
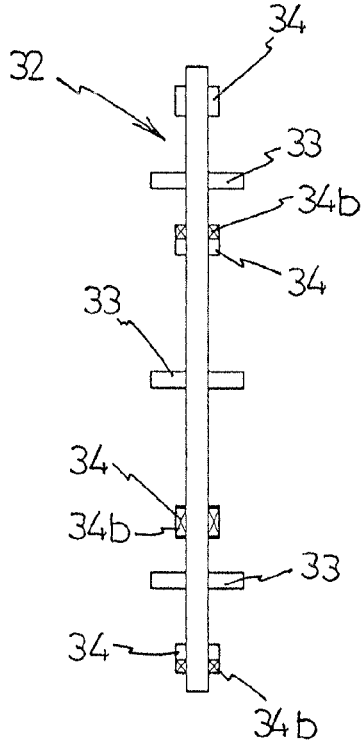
FIG. 6 is a side-view diagram of the disc-like rotor illustrated in FIG. 3.
Figure 7:
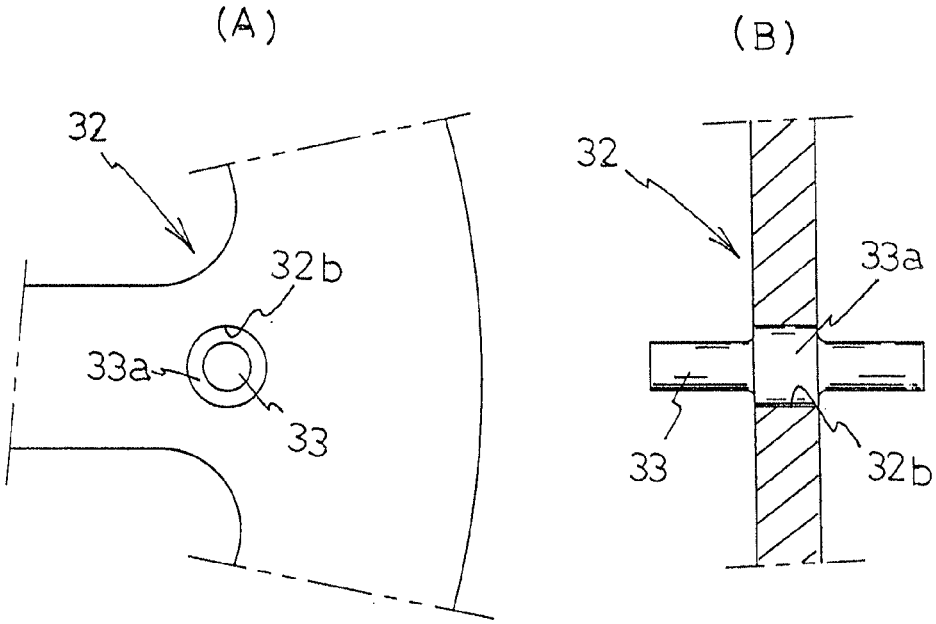
Figure 8:
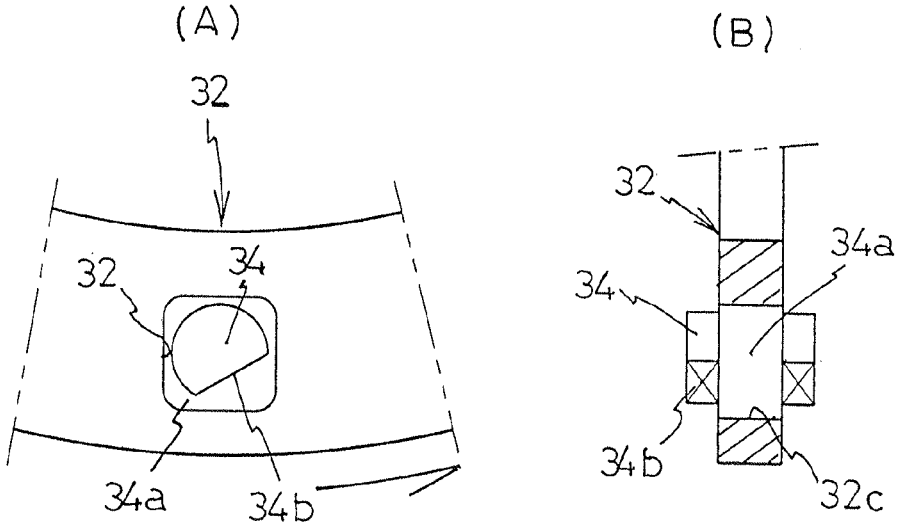

As illustrated in FIG. 4 and FIG. 7, a large-diameter cylindrical portion 33*a* is formed at an intermediate portion, in the longitudinal direction, of each pin 33. The cylindrical portions 33*a* are inserted into circular holes 32*b* that are formed in the disc-like rotors 32, and are fixed by welding or the like. As illustrated in FIG. 4 and FIG. 8, the pins 34 have each a prism portion 34*a* at an intermediate portion in the longitudinal direction, and comprise each a flat portion 34*b* that results from partially cutting out both ends of the cylindrical portion in such a manner that the cross section in the longitudinal direction is shaped as a D. As illustrated in FIG. 5 and FIG. 8, the pins 34 are fixed by inserting the prism portions 34*a* into respective rectangular holes 32*c* that are formed in the disc-like rotor 32, and by welding or the like, in such a manner that the flat portions 34*b* are disposed tilting rearwards in the advance direction of the disc-like rotors 32 as the flat portions 34*b* extend towards the peripheral edge of the disc-like rotor 32.

In the above embodiment, each pin 34 has a prism portion 34*a* formed in the intermediate portion thereof, in the longitudinal direction. The prism portions 34*a* are inserted into the rectangular holes 32*c* having the same shape, of the disc-like rotor 32, as a result of which the pins are positioned in such a manner that the orientations of the flat portions 34*b* point in a predetermined direction. However, the cross-sectional shape of the intermediate portion of the pins 34, in the longitudinal direction, may have a non-circular cross-sectional shape. Holes having a cross-sectional shape corresponding to that of the intermediate portion of the pins 34, in the longitudinal direction, are formed in the disc-like rotors 32.

The disc-like rotors 32 formed as described above are fitted onto the extension 24*a* of the drive shaft 24, with spacers 35 interposed between the disc-like rotors 32, as illustrated in FIG. 2. Further, the disc-like rotors 32 are fixed to the drive shaft 24 through screwing and fastening of a bolt 37 onto the end face of the extension 24*a*, interpolating a collar 36 between them. The distance between adjacent disc-like rotors 32 is adjusted means way of the thickness of the spacers 35.

Figure 9:
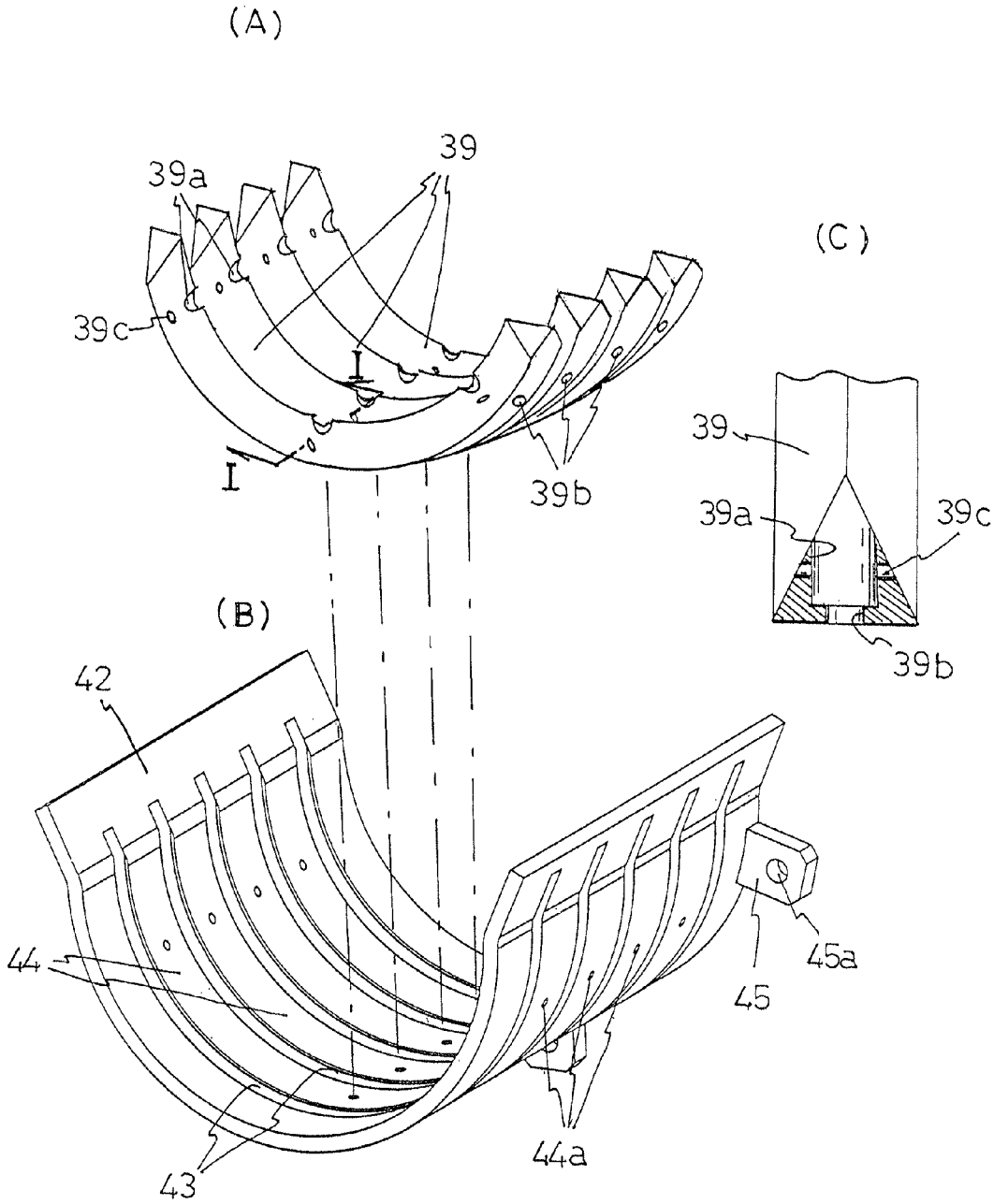
Figure 10:
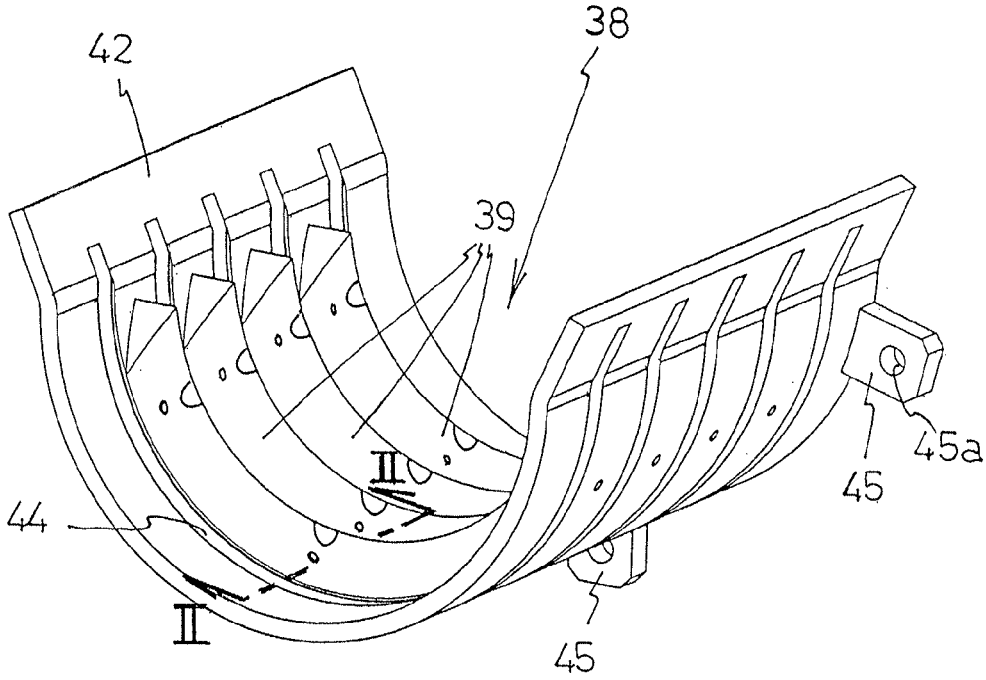
Figure 10:
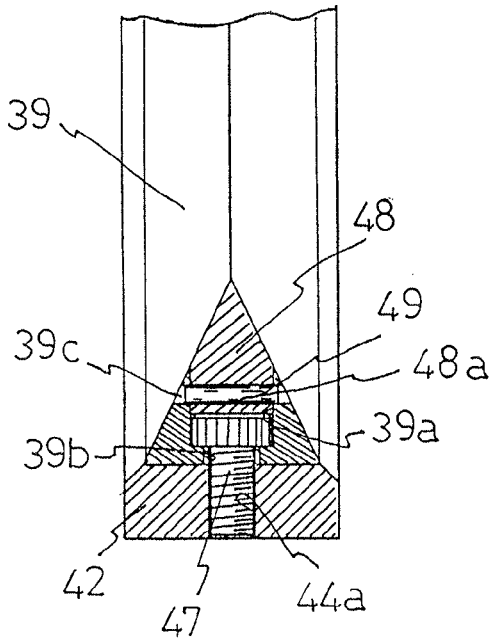

A stator assembly 38 is disposed in the lower peripheral direction of the disc-like rotors 32. As illustrated in FIG. 1, the stator assembly 38 comprises stators 39, 40, 41 having a semicircular arc shape that is concentric with the disc-like rotors 32 and having a triangular cross-sectional shape in the radial direction, and a holder 42 having a semi-tubular shape that is concentric with the disc-like rotors 32. As illustrated in FIG. 9, the cross section of the stators 39 is shaped as an isosceles triangle. A plurality of large inner-diameter circular holes 39*a* and a plurality of small inner-diameter circular holes 39*b*, being communicating to each other and concentric to each other and running from the vertex of the isosceles triangle perpendicularly to the base thereof, are disposed in the longitudinal direction of the stators 39 (respectively three in this embodiment). Circular holes 39*c* are formed perpendicular to respective circular holes 39*a*. Long holes 43 are formed parallelly and equidistantly along the circular arc of the holder 42. Band-like portions 44 for mounting the bottom face of the stators 39 are formed between the long holes 43. Female screws 44*a* are formed in the band-like portions 44, at positions corresponding to the circular holes 39*a*, 39*b* of the stators. As illustrated in FIG. 10, the stators 39 are fixed to the holder 42 by way of cap screws 47. Circular holes 48*a* communicating with the circular holes 39*c* of the stators are formed, in the horizontal direction, in caps 48 that are shaped so as to fit onto the circular holes 39*a* of the stator. After inserting the caps 48 into the circular holes 39*a* of the stator, spring pins 49 are fixed, by insertion, to the circular holes 39*c* of the stator and to the circular holes 48*a* of the caps, whereby the circular holes 39*a* of each stator 39 become plugged.

Instead of the above method, there may be formed a plurality of protrusions over the entire length of the bottom face of the stators 39, and holes may be formed in the band-like portions 44 of the holder 42, at positions corresponding to the protrusions, so that the protrusions of the stators 39 are inserted into the hole of the band-like portions 44, and are welded or the like, to fix thereby the stators 39 to the holder 42.

As illustrated in FIG. 1, the cross-sectional shape of the stators 40, 41 is a right triangle. As illustrated in FIG. 2, one of the faces of the stator 40 that forms a right angle is fixed to the bracket 23 by way of a screw 40*a*, and one of the faces of the stator 41 that forms a right angle is fixed to the side wall of the casing 31 by way of a screw 41*a*.

In the above embodiment, as illustrated in FIG. 1 and FIG. 2, the size of the stators 40, 41 is larger than that of the stators 39. Specifically, the outer diameter of the stators 40, 41 is substantially the same as that of the stators 39, but the inner diameter is smaller than that of the stators 39. The purpose of this is to allow powder and granular material that is supplied to the vicinity of the inner face of the bracket 23 and the side wall of the casing 31 to be guided quickly into a gap A, without being retained in the foregoing portions, by increasing the height of the inclined faces of the stators 40 and 41.

For the same reason, both ends of the stator 40, 41 are cut out obliquely downwards, as illustrated in FIG. 1, while both ends of the stators 39 are cut out obliquely downwards, with left-right symmetry, as illustrated in FIG. 9.

Preferably, the stators 39 (including the cap 49), 40, 41 are formed using a material that has a smooth surface, for instance polytetrafluoroethylene (PTFE) or the like.

As illustrated in FIG. 10, a plurality of stays 45 are standingly provided, in the peripheral direction, on one outer peripheral end face of the holder 42. A screw insertion hole 45*a* is formed in each stay 45. As illustrated in FIG. 1, female screws 23*b* are formed in the bracket 23, at positions corresponding to the screw insertion holes 45*a*. As illustrated in FIG. 2, the holder 42 is fixed to the bracket 23 through screwing of bolts 46, which are inserted through the screw insertion holes 45*a*, into the female screws 23*b* of the bracket 23.

Figure 11:
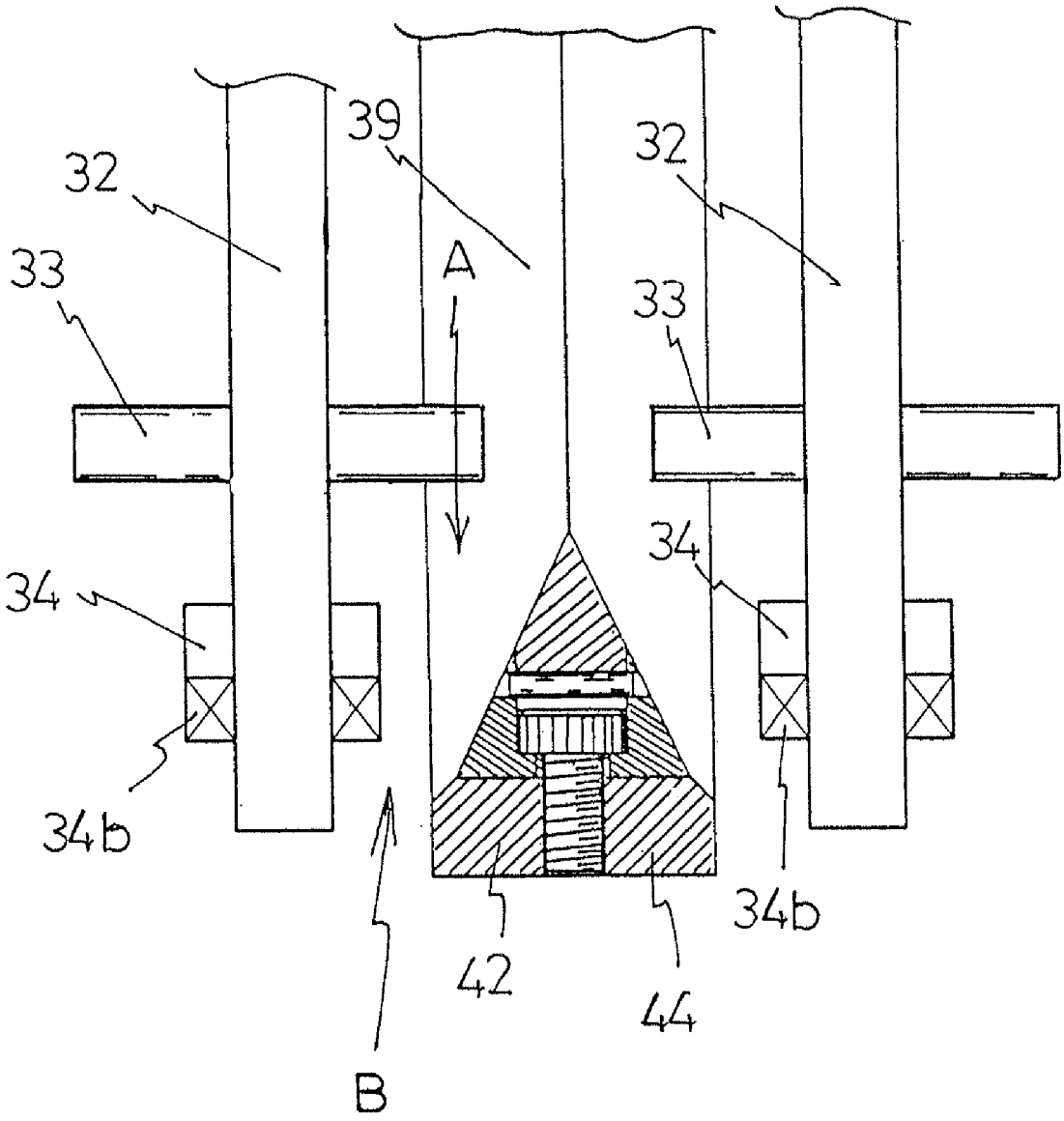
FIG. 11 is a cross-sectional diagram illustrating an enlargement of a relevant portion of a crushing and sizing section in the powder and granular material crushing and sizing apparatus according to the present invention.

In the powder and granular material crushing and sizing apparatus 1, the stators 39 are disposed below substantially the bottom half of the disc-like rotors 32, 32, between the peripheral edges of the latter. As illustrated in FIG. 11, a hopper-like gap portion A is delimited by the peripheral-edge disc face of the disc-like rotors 32 and the inclined face of the stators 39.

In the powder and granular material crushing and sizing apparatus 1, powder and granular material such as wet aggregates or dry blocks, as a raw material, is charged into the casing 31 via the feeding opening 31*a*, while the disc-like rotors 32 are rotating, whereupon the powder and granular material is firstly coarsely crushed by the pins 33. The powder and granular material, having reached the gap portion A, which is an retention zone of the powder and granular material, is pushed out into the smallest gap portion B on account of the centrifugal force exerted by the rotating disc-like rotors 32, and by the push-out force of the flat portions 34*a* of the pins 34. From among the powder and granular material pushed out into the smallest gap portion B, those particles that match the gap setting are allowed to pass through, while particles that do not are crushed in the gap portion A, and are discharged thereafter through the smallest gap portion B into a discharge opening.

To clean the disc-like rotors 32 and the stators 39, 40, 41 of the powder and granular material crushing and sizing apparatus 1, the casing 31 is removed from the bracket 23, and then the holder 42 is removed from the bracket 23. Doing so exposes the peripheral edges of the disc-like rotors 32, and the stators 39, 40, 41, which can then be cleaned easily.

To replace the disc-like rotors 32 of the powder and granular material crushing and sizing apparatus 1, the casing 31 is removed from the bracket 23, and then the stator assembly 38 is removed from the bracket 23. Next, the bolt 37 and the collar 36 are removed from the drive shaft 24, and the disc-like rotors 32 and the spacers 35 are sequentially removed from the drive shaft 24. To complete the replacement, new disc-like rotors 32 are then inserted and fitted to the drive shaft 24, with the spacers 35 interposed in between, and the bolt 37 is mounted to the drive shaft 24. As described above, the disc-like rotors 32 and the spacers 35 can be precisely cleaned by being removed from the drive shaft 24.

To replace the stators 39, the casing 31 is removed from the bracket 23, and then the stator assembly 38 is removed from the bracket 23. Replacement is completed by mounting the stator assembly 38, provided with new stators 39, onto the bracket 23.

To replace the stator 40, the casing 31 is removed from the bracket 23, and then the stator assembly 38 is removed from the bracket 23. The stator 40 is removed from the bracket 23, and then replacement is completed by mounting the new stator 40 onto the bracket 23.

To replace the stator 41, the casing 31 is removed from the bracket 23, the stator 41 is removed from the casing 31, and then replacement is completed by mounting the new stator 41 onto the casing 31.

To modify the crushing and sizing particle size in the powder and granular material crushing and sizing apparatus 1, there must be modified the smallest gap portion B between the peripheral edges of the disc-like rotors 32 and the stators 39, 40, 41. In this case, a stator assembly 38 may be prepared in which modified stators 39 (wherein, specifically, the length of the base of the cross-sectional isosceles triangle is modified with respect to the width of the band-like portions 44) are disposed on the holder 42, the width of the long holes 43 whereof is likewise modified, and stators 40, 41 of modified cross-sectional shape and size (modified length of the base of the cross-sectional right triangle) are prepared. The foregoing are then mounted onto the bracket 23 of the bearing housing 21 and the casing 31.

In the apparatus set forth in the above Patent document (Japanese Patent No. 4113222), a plurality of spike-shaped protrusions, arranged as two rows in the radial direction around a rotation shaft, with a predetermined spacing between protrusions both in the radial and the circumferential directions, is formed on both disc faces at the outermost peripheral edge of the discs; and also, a plurality of spike-shaped protrusions, arranged as a row along the circumferential direction with a predetermined spacing between protrusions, is formed on the faces of adapters that oppose the above disc faces in the outermost peripheral edges of the discs. Similar protrusions may also be formed in the present invention, but are not necessary if the material to be processed is a pharmaceutical product.

What is claimed is:

1. A powder and granular material crushing and sizing apparatus in which a powder and granular material fed through an upper feeding opening of a casing is crushed and sized at gaps that are formed by peripheral-edge disc faces of a plurality of disc-like rotors disposed, at a predetermined spacing, on a horizontal drive shaft, and a plurality of stators disposed between lower peripheral edges of the plurality of disc-like rotors, and in which the crushed and sized powder and granular material is discharged towards a bottom discharge opening of the casing;

wherein the drive shaft is supported in a cantilever manner on a bearing housing, the plurality of stators are disposed on a holder to make up a stator assembly, the stator assembly is detachably disposed in the bearing housing, an opening is formed on a side wall of the casing, the disc-like rotors and the stator assembly are housed via the opening, and the casing is detachably disposed on the bearing housing.

2. The powder and granular material crushing and sizing apparatus according to claim 1, wherein the stator assembly is comprised of a holder that has a semi-tubular form concentric with said disc-like rotors, and that has a plurality of slits running along the peripheral direction at the lower portion thereof so that flat portions are formed between the slits, and a plurality of stators disposed on those flat portions; the stators having a triangle form in the cross-section parallel to the longitudinal direction and having a semicircular form in the plane perpendicular to the longitudinal direction.

3. The powder and granular material crushing and sizing apparatus according to claim 1, wherein cylindrical pins having a flat portion in a part thereof are standingly provided on the peripheral-edge disc faces of the disc-like rotors, in such a manner that the flat portion tilts rearwards in an advance direction of the disc-like rotors as the flat portion extends towards the peripheral edge of the disc-like rotor.

4. The powder and granular material crushing and sizing apparatus according to claim 3, wherein an intermediate portion of the pins, in the longitudinal direction, is shaped as a non-cylinder, holes having a shape corresponding to a cross sectional shape of the intermediate portion of the pins are formed in the disc-like rotors, and the flat portions of the pins are positioned so as to face towards a predetermined direction by inserting the intermediate portion of the pins into the holes.

5. The powder and granular material crushing and sizing apparatus according to claim 1, wherein the stators are formed of polytetrafluoroethylene.

* * * * *